US008376871B1

(12) United States Patent
Cloud

(10) Patent No.: US 8,376,871 B1
(45) Date of Patent: Feb. 19, 2013

(54) GOLF PUTTING GAME APPARATUS

(76) Inventor: Ira L. Cloud, Middleburg, FL (US)

( * ) Notice: Subject to any disclaimer, the term of this patent is extended or adjusted under 35 U.S.C. 154(b) by 131 days.

(21) Appl. No.: 12/889,206

(22) Filed: Sep. 23, 2010

(51) Int. Cl.
*A63B 69/36* (2006.01)

(52) U.S. Cl. ..... 473/163; 473/179

(58) Field of Classification Search ..... 473/157–166, 473/173–185
See application file for complete search history.

(56) References Cited

U.S. PATENT DOCUMENTS

| | | | | | |
|---|---|---|---|---|---|
| 3,424,463 | A * | 1/1969 | Matthews | 473/163 |
| 4,240,637 | A | 12/1980 | Cross et al. | |
| 4,743,027 | A | 5/1988 | Simjian | |
| 4,906,006 | A * | 3/1990 | Sigunick | 473/185 |
| 4,953,865 | A | 9/1990 | Coombs et al. | |
| 5,078,394 | A * | 1/1992 | Kretz | 473/179 |
| 5,123,651 | A * | 6/1992 | Vinciguerra | 473/163 |
| 5,390,917 | A * | 2/1995 | Mendoza | 473/179 |
| 5,431,403 | A * | 7/1995 | Pelz | 473/160 |
| 5,524,891 | A * | 6/1996 | Owen et al. | 473/196 |
| 5,529,304 | A * | 6/1996 | Wood | 473/163 |
| 5,595,543 | A | 1/1997 | Wolk | |
| 5,776,004 | A * | 7/1998 | Wilson | 473/179 |
| 6,569,027 | B2 * | 5/2003 | Florian | 473/160 |
| 6,709,342 | B1 * | 3/2004 | Brezic | 473/179 |
| 2004/0152529 | A1 * | 8/2004 | Chen | 473/159 |
| 2007/0099716 | A1 * | 5/2007 | Du Plessis | 473/179 |

OTHER PUBLICATIONS

Putt Pucks. http://www.puttpucks.com/ Accessed Jan. 22, 2010.

* cited by examiner

*Primary Examiner* — Mark Graham
(74) *Attorney, Agent, or Firm* — Montgomery Patent & Design LLC; Robert C. Montgomery

(57) ABSTRACT

A golf putting game apparatus comprises a ramp, a plurality of selectable rings, and a ball return mechanism. The ramp comprises a durable body having a horizontal surface portion at an upper end. The ramp is disposed with a suitable golf putting surface. The plurality selectable rings further comprise a large round target hole, a support assembly, and a plurality of concentric targets. The support assembly comprises a plurality of small horizontal supports which extends inward from a bottom edge of the target hole. The plurality of concentric targets comprise a plurality of flat concentric rings which fit inside each other, with the largest fitting correspondingly inside the inner perimeter of the target hole. The ball return mechanism comprises a return chute which returns a golf ball to the side of the ramp upon successfully placing the ball in the target. By selectively placing a desired number of concentric targets, a user may shrink the diameter of the target in order to increase the difficulty.

11 Claims, 5 Drawing Sheets

GOLF PUTTING GAME APPARATUS

RELATED APPLICATIONS

The present invention was first described in a notarized Official Record of Invention on Dec. 16, 2009, that is on file at the offices of Montgomery Patent and Design, LLC, the entire disclosures of which are incorporated herein by reference.

FIELD OF THE INVENTION

The present invention relates generally to golf, and in particular, to an apparatus which provides a means for adjustable putting training exercises.

BACKGROUND OF THE INVENTION

The game of golf is one of the most popular in the world today. Due to the highly precise nature of the game play, golf also constitutes one (1) of the most technologically advanced sports in the world with regards to equipment. Success in the sport of golf is predicated upon the ability to perform highly accurate movements with a high level of repeatability. As a result, the equipment is engineered to provide a high level of control, and training routines generally involve extensive repetition of various motions including driving, chipping, and putting.

As noted, many aspects of golf such as driving are learned via continuous repeated motion and adaptation to increase the effectiveness of the motion. However, putting represents an aspect of golf which is largely predicated upon the particulars of technique, accuracy, and consistency and less so on developing a powerful or effective swinging method such as is the case in driving. Putting practice generally consists of repeated putting towards a target hole in pursuit of the ability to consistently sink a putt. However, the speed and effectiveness of such putting exercises relies upon having a suitable location for repeated putts. Furthermore, if such a location proves to be particularly difficult, a user may either find it very difficult to repeatedly make the putt which leads to aggravation and discouragement. The other option is to practice putting from closer to the hole; however, this prevents the user from practicing motioning and aiming from longer distances, which differ significantly from closer putts. This, in turn, limits the effectiveness of the putting practice.

Various attempts have been made to provide golf putting practice apparatuses. Examples of these attempts can be seen by reference to several U.S. patents. U.S. Pat. No. 4,240,637, issued in the name of Cross et al., describes a putting practice apparatus with variable sloping capabilities.

U.S. Pat. No. 4,953,865, issued in the name of Coombs et al., describes a putting practice device with a series of insertable pegs for providing a guiding target lane during putting exercises.

U.S. Pat. No. 5,431,403, issued in the name of Pelz, describes a golf putting device with a variable height and narrow construction to practice short distance putts at a variety of angles.

U.S. Pat. No. 5,524,891, issued in the name of Owen, Jr. et al., describes a golf practice hole with a variable diameter rim.

While these apparatuses fulfill their respective, particular objectives, each of these references suffer from one (1) or more of the aforementioned disadvantages. Many such apparatuses do not provide a sufficient length and width for putting practice. Also, many such apparatuses are cumbersome to set up or adjust. Furthermore, many such apparatuses do not provide a sufficient range of adjustability, particularly with regards to target size. In addition, many such apparatuses do not sufficiently mimic realistic game play conditions and targets. Accordingly, there exists a need for a golf putting game apparatus without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to practice putting for the game of golf in a manner which simulates a realistic putting situation and which further provides a scaling target which provides users of differing or changing skill levels the ability to adjust the size and relative difficultly of striking the target. Thus, the object of the present invention is to solve the aforementioned disadvantages and provide for this need.

To achieve the above objectives, it is an object of the present invention to provide a means for a golf putting training aid. The apparatus comprises a ramp and an adjustable cup assembly.

Another object of the present invention is to simulate a realistic golf putting scenario via positioning of the cup at a top portion of the ramp, allowing a user to strike a golf ball with a putter upwardly onto the ramp and into the cup assembly.

Yet still another object of the present invention is to simulate realistic putting conditions via constructing the ramp surface of a rough material such as artificial golfing turf.

Yet still another object of the present invention is to allow a user to selectively adjust the difficulty of the apparatus via a plurality of concentric rings which provide a means to discretely decrease the size of the target aperture.

Yet still another object of the present invention is to prevent a golf ball from rolling off of the upper surface of the ramp via a plurality of ball catches along the perimeter edges. Each ball catch comprises a rectangular cutout of width greater than the ball's diameter.

Yet still another object of the present invention is to provide automatic return of a made ball. The cup comprises a funnel-shaped portion which directs the ball towards a diverter and exit aperture, allowing the ball to roll out of the side of the ramp for reuse by a user.

Yet still another object of the present invention is to provide stability to the apparatus via a cup leg integrally molded into a base portion of the cup.

Yet still another object of the present invention is to provide a method of utilizing the device that provides a unique means of obtaining an instance of the apparatus, positioning the apparatus on a level surface, placing a golf ball at a lower surface of the ramp, striking the ball so as to travel up the ramp, catching the ball in a ball catch in the case of a miss, returning the ball via the exit aperture in the case of a made putt, and allowing a user to selectively adjust the difficulty of successfully hitting the target aperture via addition or removal of rings in order to adjust the diameter of the target.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | golf putting game apparatus |
| 15 | golfer |
| 16 | golf ball |
| 17 | putter |
| 20 | ramp |
| 21 | ramp surface |
| 22 | upper surface |
| 23 | side surface |
| 24 | exit aperture |
| 25 | bottom surface |
| 26 | rear surface |
| 27 | ball catch |
| 30 | cup assembly |
| 31 | outer ring |
| 32 | intermediate ring |
| 33 | inner ring |
| 34 | cup |
| 35 | cup interior surface |
| 36 | arm |
| 37 | diverter |
| 38 | cup leg |
| 39 | base |
| 40 | fastener |
| 41 | cup aperture |

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Figure 1:
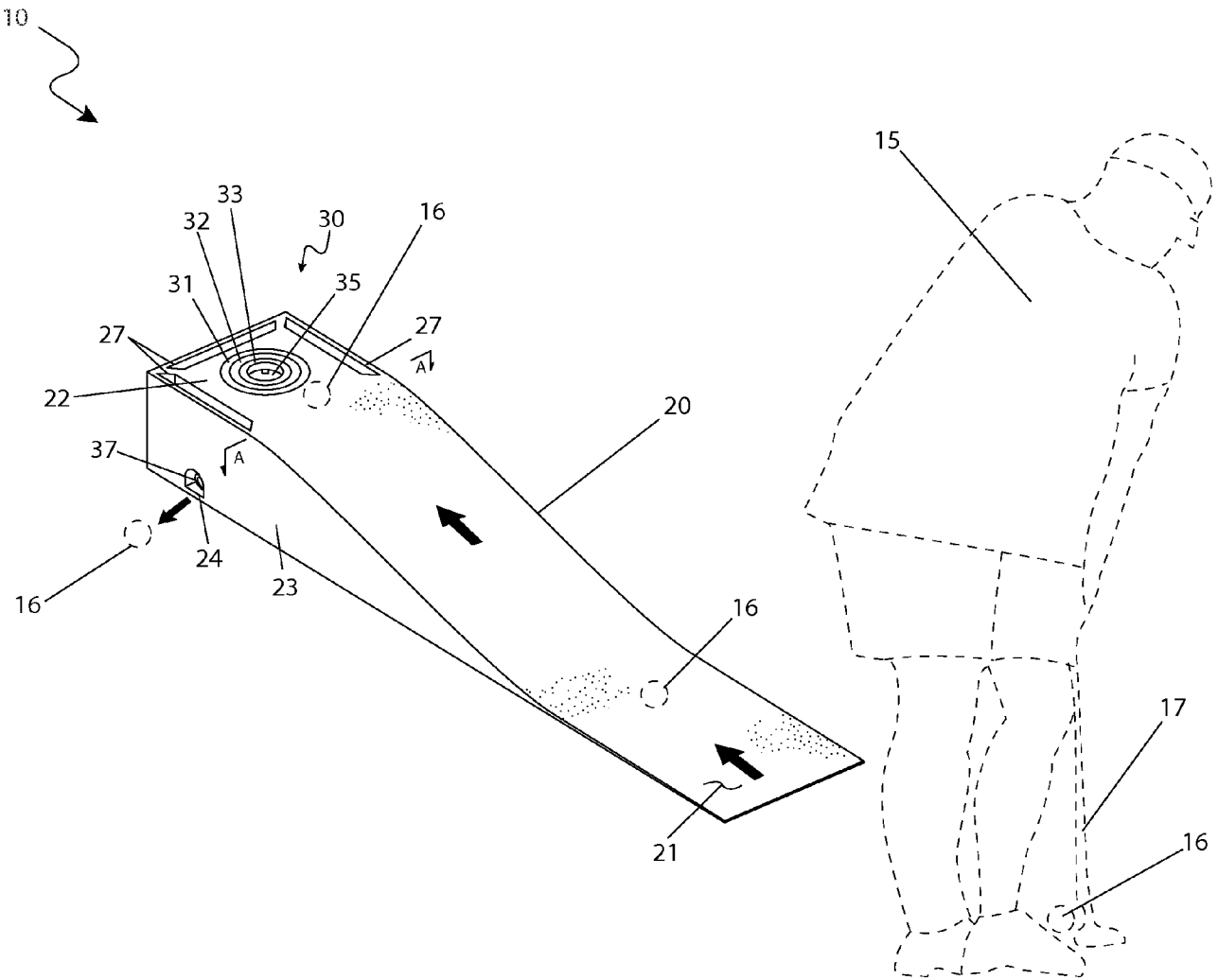
FIG. 1 is an environmental view of a golf putting game apparatus 10, according to a preferred embodiment of the present invention.

The present invention describes a golf putting game apparatus (herein described as the "apparatus") 10, which provides a means for a golf putting training aid. The apparatus 10 enables a golfer 15 to practice their putting skills in a desired location on a level surface. Referring now to FIG. 1, an environmental view of the apparatus 10, according to the preferred embodiment of the present invention, is disclosed. The apparatus 10 comprises a ramp 20 and an adjustable cup assembly 30 which enables the golfer to strike a golf ball 16 via a putter 17 upwardly upon the ramp 20 and into the cup assembly 30 for practicing aim and precision of putting. The struck golf ball 16, after descending into the cup assembly 30, exits from a side surface 23 for reuse.

Figure 2:
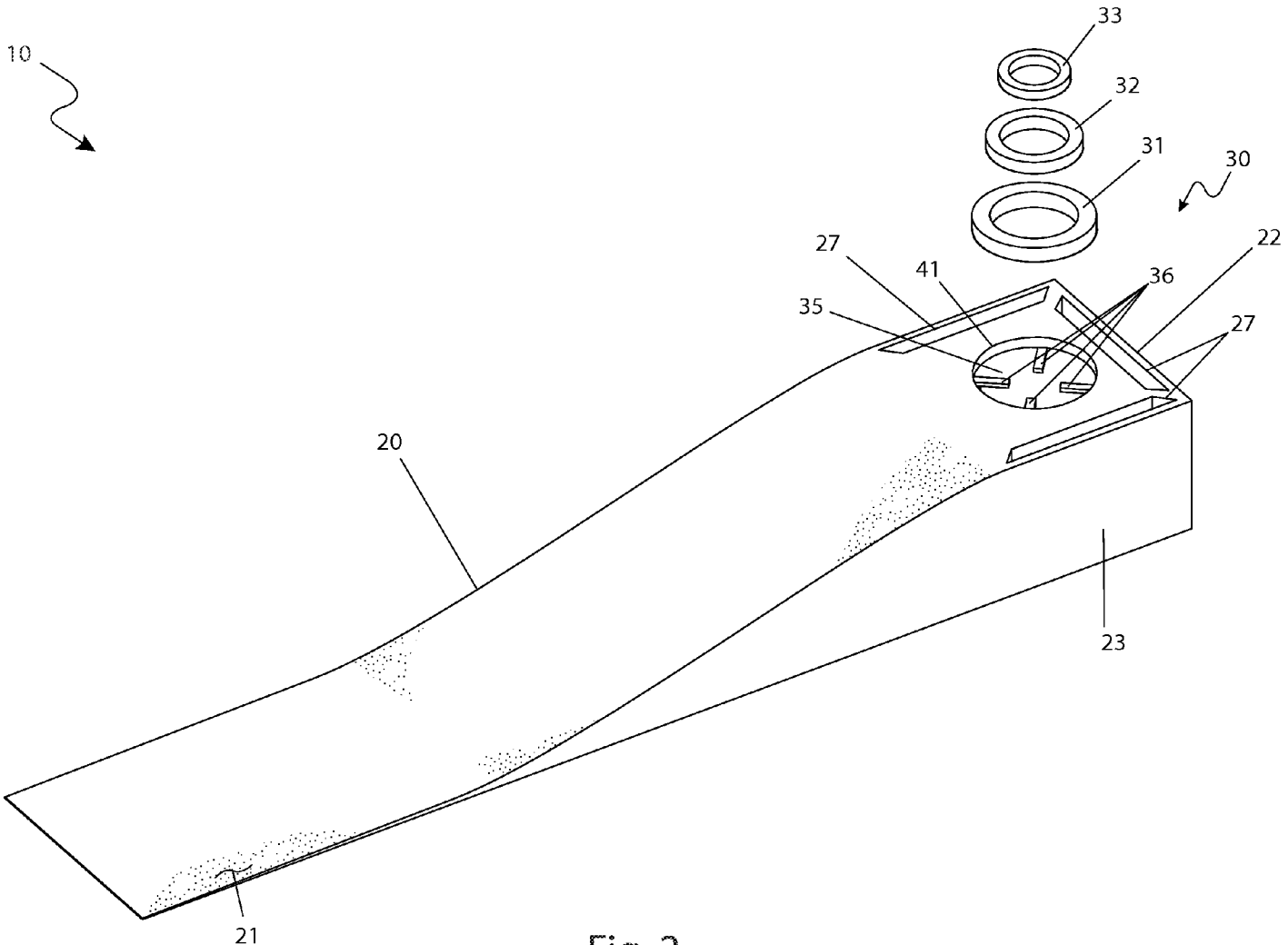
FIG. 2 is a perspective view of the golf putting game apparatus 10, according to a preferred embodiment of the present invention.
Figure 3:
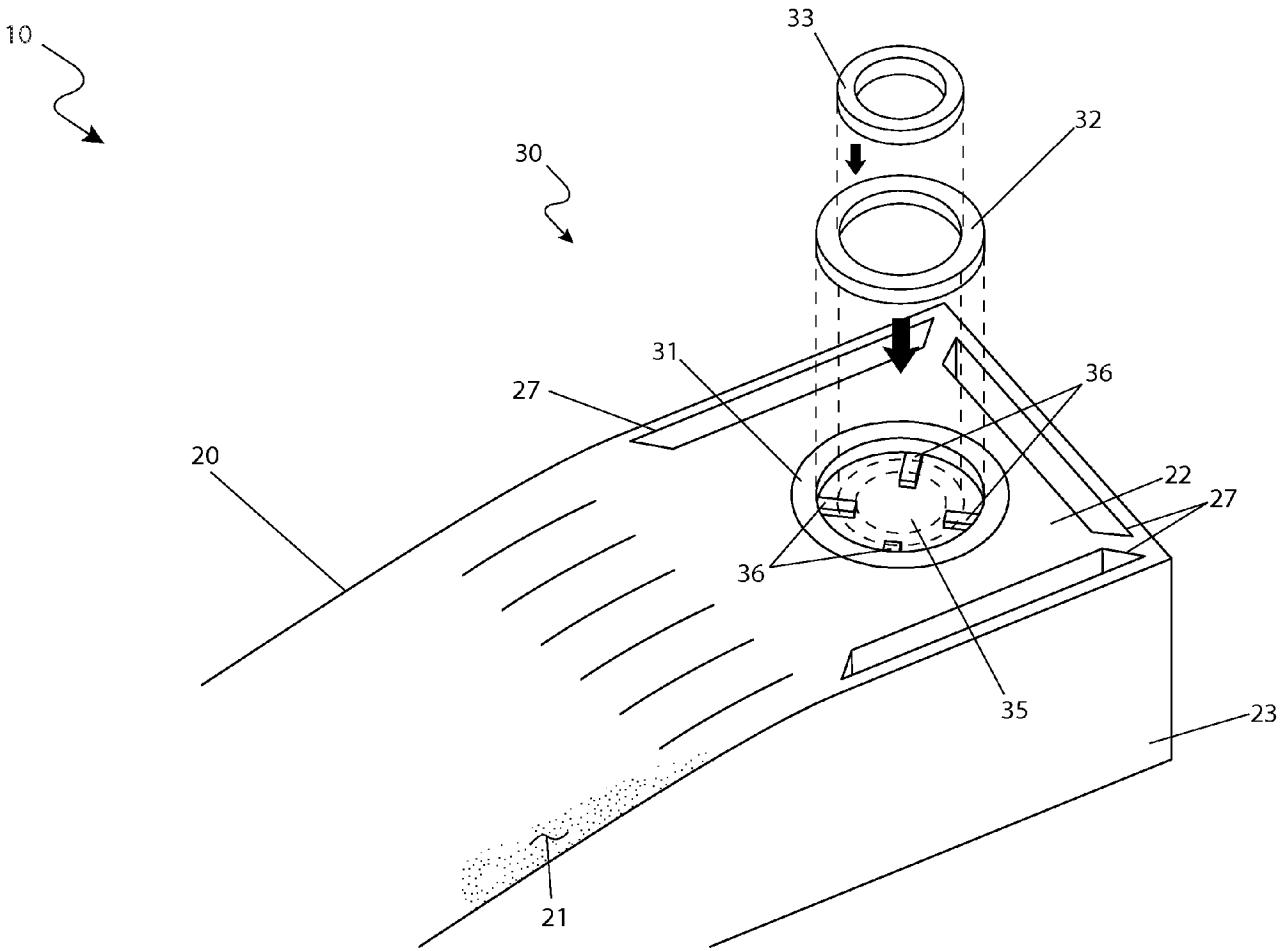
FIG. 3 is a close-up perspective view of the golf putting game apparatus 10 depicting a cup assembly 30, according to a preferred embodiment of the present invention.

Referring now to FIG. 2, a perspective view of the apparatus 10 and FIG. 3, close-up perspective view of the apparatus 10 depicting the cup assembly 30, according to the preferred embodiment of the present invention, are disclosed. The apparatus 10 comprises a ramp 20 which provides an inclined surface for the golf ball 16 to travel upon. The ramp's 20 inclined body is comprised of an upper surface 22, a pair of side surfaces 23, a bottom surface 25, and a rear surface 26. The ramp 20 measures approximately two (2) feet in length by fifteen (15) inches in width by three (3) inches in height (measured at the uppermost point of said ramp 20). The ramp 20 is fabricated from materials such as, but not limited to: plastic, metal, wood, or the like. An outer ramp surface 21, that which the golf ball 16 travels upon, is preferably comprised of an artificial golfing turf, yet other surfaces may be utilized without limiting the scope of the apparatus 10.

The upper surface 22 is comprised of a level raised portion of the ramp 20 measuring approximately fifteen (15) inches in width and twelve (12) inches in length. The upper surface 22 houses the cup assembly 30 which provides an area for the golfer 15 to aim the golf ball 16 and an area for said golf ball 16 to enter a cup aperture 41. The cup assembly 30 comprises an outer ring 31, an intermediate ring 32, and an inner ring 33 which provides a means to adjust an upper diameter of the cup aperture 41 (see FIGS. 4 and 5). Each ring 31, 32, 33 reduces in diameter to fit within each other, thereby reducing the diameter of the cup aperture 41. The outer ring 31 fits within the inner diameter of the cup aperture 41, the intermediate ring 32 fits within the inner diameter of the outer ring 31 and the inner ring 33 fits within the inner diameter of said intermediate ring 32 which selectively manipulates the upper diameter of the cup 34. The diameter of the cup aperture 41 measures approximately eight (8) inches in diameter, the inner diameter of the outer ring 31 measures approximately six (6) inches in diameter, the inner diameter of the intermediate ring 32 measures approximately four (4) inches in diameter, and the inner diameter of the inner ring 33 measures approximately two (2) inches in diameter. The rings 31, 32, 33 are rested on an upper surface of a plurality of protruding arms 36 which are integrally molded into the upper surface of the cup aperture 41. Each arm 36 measures approximately three (3) inches in length which enables each ring 31, 32, 33 to be secured level with the upper surface 22. In use, a ring 31, 32, 33 is positioned onto the arms 36 to decrease the upper diameter of the cup aperture 41 and increase the complexity of the apparatus 10. The rings 31, 32, 33 are preferably fabricated from materials such as, but not limited to: plastic, metal, or the like.

The upper surface 22 also comprises a plurality of ball catches 27 which prohibit golf balls 16 from rolling off of said upper surface 22 after being struck in an inaccurate manner upon the ramp 20. The ball catches 27 are comprised of rectangular cut-outs along the perimeter edges of the upper surface 22 which further border the cup assembly 30. Each ball catch 27 comprises a width measuring approximately one (1) inch in width which is slightly larger than the diameter of the golf ball 16 to enable said golf ball 16 to rest within said ball catch 27. In use, if the golf ball 16 is struck off-center or beyond the cup assembly 30, said golf ball 16 will become obstructed within the ball catch 27 and prohibited from descending off of the upper surface 22.

Figure 4:
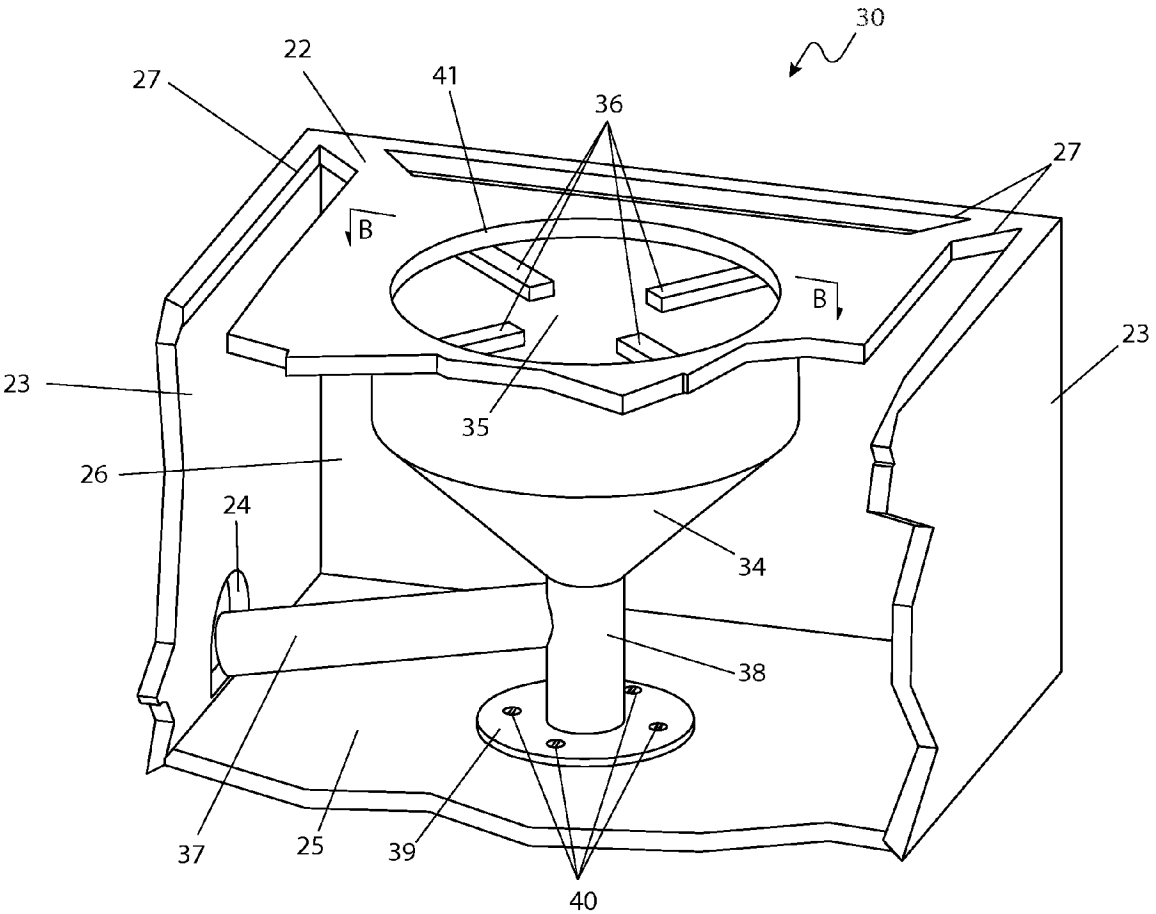
FIG. 4 is a section view of the golf putting game apparatus taken along line A-A (see FIG. 1) 10, according to a preferred embodiment of the present invention; and, FIG. 5 is a section view of the cup assembly 30 taken along line B-B (see FIG. 4) 10, according to a preferred embodiment of the present invention.
Figure 5:
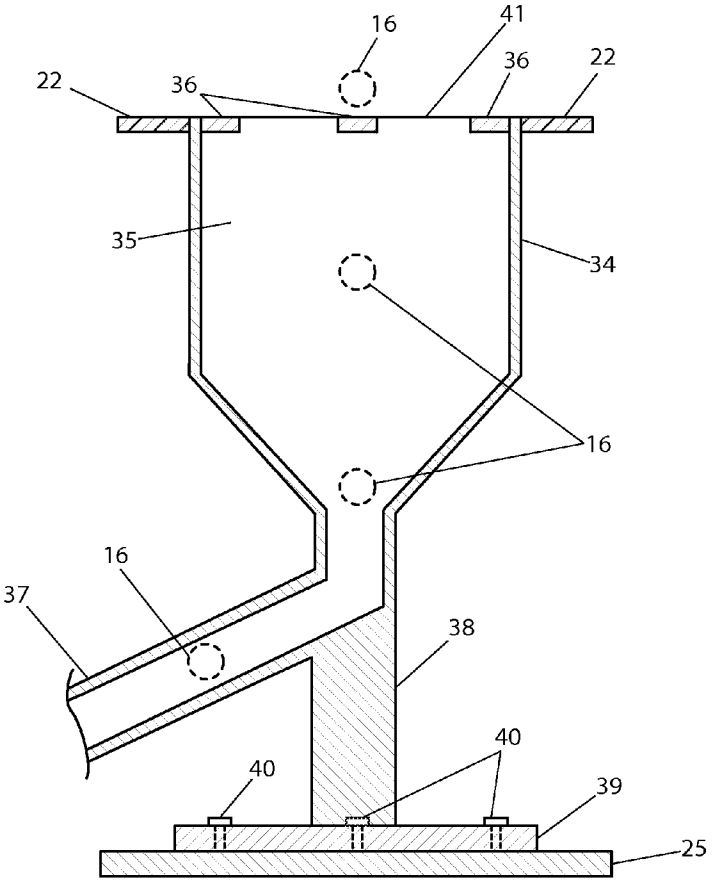

Referring now to FIG. 4, a section view of the apparatus 10 taken along line A-A (see FIG. 1) and FIG. 5, section view of the cup assembly 30 taken along line B-B (see FIG. 4), according to the preferred embodiment of the present invention, are disclosed. The cup assembly 30 further comprises a cup 34, as abovementioned, which provides a means to receive a golf ball 16 and direct the golf ball 16 through an exit aperture 24 located on a side surface 23 of the ramp 20. The cup 34 is housed within a rear portion of the ramp 20 at an intermediate location between the side surfaces 23, bottom surface 25, and rear surface 26 and is integrally molded to the upper surface 22. The cup 34 comprises a funnel-shape further comprising a diverter 37, a cup leg 38, and a base 39. The golf ball 16 descends into a cup interior surface 35 and is funneled downwardly into the diverter 37. The diverter 37 is integrally molded into a side surface of the cup leg 38 and comprises a cylindrical-shape positioned at a slight downward angle which is further aligned with the exit aperture 24 to enable the golf ball 16 to exit the apparatus 10.

The cup leg 38 comprises a cylindrical shape and enables the cup 34 to be secured to the bottom surface 25. The cup leg 38 is integrally molded into the circular base 39 which provides stability to the cup 34 and a fastening means to the bottom surface 25. A plurality of conventional fasteners 40 such as screws are inserted into the base 39 and further into the bottom surface 25 which provides the attachment means.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of installing and utilizing the apparatus 10 may be achieved by performing the following steps: acquiring the apparatus 10; positioning the apparatus 10 on a level surface; striking a golf ball 16 via a putter 17 in a common manner upon the ramp 20 aiming for the cup interior surface 35 via the cup aperture 41; enabling the golf ball 16 to travel into the cup 34, through the diverter 37, and out of the exit aperture 24; retrieving the golf ball 16 from a ball catch 27 as needed for inaccurate shots; repeating as desired; and, enabling a golfer 15 to improve their game in a manner that is fun, easy, and efficient.

The method of installing and utilizing the apparatus 10 with the outer ring 31 may be achieved by performing the following steps: acquiring the apparatus 10; positioning the apparatus 10 on a level surface; positioning the outer ring 31 upon the arms 36; striking a golf ball 16 via a putter 17 in a common manner upon the ramp 20 aiming for the cup interior surface 35 via the cup aperture 41; enabling the golf ball 16 to travel into the cup 34, through the diverter 37, and out of the exit aperture 24; repeating as desired; and, enabling a golfer 15 to improve their game in a manner that is fun, easy, and efficient.

The method of installing and utilizing the apparatus 10 with the outer ring 31 and intermediate ring 32 may be achieved by performing the following steps: acquiring the apparatus 10; positioning the apparatus 10 on a level surface; positioning the outer ring 31 upon the arms 36; positioning the intermediate ring 32 upon the arms 36 concentric to the outer ring 31; striking a golf ball 16 via a putter 17 in a common manner upon the ramp 20 aiming for the cup interior surface 35 via the cup aperture 41; enabling the golf ball 16 to travel into the cup 34, through the diverter 37, and out of the exit aperture 24; repeating as desired; and, enabling a golfer 15 to improve their game in a manner that is fun, easy, and efficient.

The method of installing and utilizing the apparatus 10 with the outer ring 31, intermediate ring 32, and inner ring 33 may be achieved by performing the following steps: acquiring the apparatus 10; positioning the apparatus 10 on a level surface; positioning the outer ring 31 upon the arms 36; positioning the intermediate ring 32 upon the arms 36 concentric to the outer ring 31; positioning the inner ring 33 upon the arms 36 concentric to the intermediate ring 32; striking a golf ball 16 via a putter 17 in a common manner upon the ramp 20 aiming for the cup interior surface 35 via the cup aperture 41; enabling the golf ball 16 to travel into the cup 34, through the diverter 37, and out of the exit aperture 24; repeating as desired; and, enabling a golfer 15 to improve their game in a manner that is fun, easy, and efficient.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A golf putting game apparatus for enabling golfers to practice their putting skills at a desired location, said golf putting game apparatus comprising:

a ramp adapted to receive a golf ball thereon, said ramp further having an exit aperture; and, an adjustable cup assembly attached to said ramp and disposed therein such that said cup assembly is in communication with said exit aperture;

wherein said cup assembly comprises:

a cup having a central longitudinal axis;

a cup leg directly attached to a bottom-most end of said cup, said cup leg being aligned with the central longitudinal axis;

a diverter directly attached to said cup leg and said exit aperture;

a base attached to a bottom-most end of said cup leg and extending downwardly therefrom; and a plurality of protruding arms statically attached to said cup, each of said protruding arms having an outermost lateral end terminating at an inner wall of said cup;

wherein said diverter angles downward away from said cup;

wherein said diverter terminates at said exit aperture;

wherein each of said protruding arms is entirely located within a perimeter of said cup.

2. The golf putting game apparatus of claim 1, wherein said adjustable cup assembly further comprises:

a cup aperture formed in an upper surface of said ramp;

a plurality of ball catches attached to side surfaces of said ramp;

wherein said ball catches are situated along perimeter edges of said upper surface of said ramp;

wherein said cup is attached to said upper surface of said ramp.

3. The golf putting game apparatus of claim 2, wherein said adjustable cup assembly further comprises:

an outer ring removably fitted within an inner diameter of said cup aperture and seated on said protruding arms;

an intermediate ring removably fitted within an inner diameter of said outer ring; and, an inner ring removably fitted within an inner diameter of said intermediate ring.

4. The golf putting game apparatus of claim 3, wherein said outer ring, said intermediate ring and said inner ring are rested on an upper surface of said protruding arms;

wherein said cup is adapted to receive and direct a golf ball through said exit aperture located on one of said side surfaces of said ramp; and, wherein said outer ring, said intermediate ring and said inner ring are secured in a level position with said upper surface of said ramp.

5. The golf putting game apparatus of claim 4, wherein said outer ring, said intermediate ring and said inner ring having respectively smaller diameters concentrically fitted at said cup aperture.

6. A golf putting game apparatus for enabling golfers to practice their putting skills at a desired location, said golf putting game apparatus comprising:

an inclined ramp adapted to receive a golf ball thereon, said ramp further having an exit aperture; and, an adjustable cup assembly attached to said ramp and disposed therein such that said cup assembly is in communication with said exit aperture;

wherein said cup assembly comprises:

a cup having a central longitudinal axis;

a cup leg directly attached to a bottom-most end of said cup, said cup leg being aligned with the central longitudinal axis;

a diverter directly attached to said cup leg and said exit aperture;

a base attached to a bottom-most end of said cup leg and extending downwardly therefrom; and, a plurality of protruding arms statically attached to said cup, each of said protruding arms having an outermost lateral end terminating at an inner wall of said cup;

wherein said diverter angles downward away from said cup;

wherein said diverter terminates at said exit aperture;

wherein each of said protruding arms is entirely located within a perimeter of said cup.

7. The golf putting game apparatus of claim 6, wherein said adjustable cup assembly further comprises:

a cup aperture formed in an upper surface of said ramp;

a plurality of ball catches attached to side surfaces of said ramp;

wherein said ball catches are situated along perimeter edges of said upper surface of said ramp; and, wherein said cup is attached to said upper surface of said ramp.

8. The golf putting game apparatus of claim 7, wherein said adjustable cup assembly further comprises:

an outer ring removably fitted within an inner diameter of said cup aperture and seated on said protruding arms;

an intermediate ring removably fitted within an inner diameter of said outer ring; and, an inner ring removably fitted within an inner diameter of said intermediate ring.

9. The golf putting game apparatus of claim 8, wherein said outer ring, said intermediate ring and said inner ring are rested on an upper surface of said protruding arms;

wherein said cup is adapted to receive and direct a golf ball through said exit aperture located on one of said side surfaces of said ramp; and, wherein said outer ring, said intermediate ring and said inner ring are secured in a level position with said upper surface of said ramp.

10. The golf putting game apparatus of claim 9, wherein said outer ring, said intermediate ring and said inner ring having respectively smaller diameters concentrically fitted at said cup aperture.

11. A method of utilizing a golf putting game apparatus for enabling golfers to practice their putting skills at a desired location, said method comprising the steps of:

providing an inclined ramp having an exit aperture;

providing and attaching an adjustable cup assembly to said ramp;

disposing said adjustable cup assembly in said ramp such that said adjustable cup assembly is in communication with said exit aperture; and, putting a golf ball on said ramp thereby causing said golf ball to enter said adjustable cup assembly and exit from said exit aperture;

wherein said cup assembly comprises:

a cup having a central longitudinal axis;

a cup leg directly attached to a bottom-most end of said cup, said cup leg being aligned with the central longitudinal axis;

a diverter directly attached to said cup leg and said exit aperture;

a base attached to a bottom-most end of said cup leg and extending downwardly therefrom; and, a plurality of protruding arms statically attached to said cup, each of said protruding arms having an outermost lateral end terminating at an inner wall of said cup;

wherein said diverter angles downward away from said cup;

wherein said diverter terminates at said exit aperture;

wherein each of said protruding arms is entirely located within a perimeter of said cup.

* * * * *